US007239999B2

(12) United States Patent
Rhee

(10) Patent No.: US 7,239,999 B2
(45) Date of Patent: Jul. 3, 2007

(54) SPEED CONTROL PLAYBACK OF PARAMETRIC SPEECH ENCODED DIGITAL AUDIO

(75) Inventor: Changwon D. Rhee, Flushing, NY (US)

(73) Assignee: Intel Corporation, Santa Clara, CA (US)

( * ) Notice: Subject to any disclaimer, the term of this patent is extended or adjusted under 35 U.S.C. 154(b) by 1095 days.

(21) Appl. No.: 10/200,328

(22) Filed: Jul. 23, 2002

(65) Prior Publication Data

US 2004/0019491 A1 Jan. 29, 2004

(51) Int. Cl.
*G10L 21/00* (2006.01)

(52) U.S. Cl. ..... 704/211; 704/207

(58) Field of Classification Search ..... 704/207, 704/211

See application file for complete search history.

(56) References Cited

U.S. PATENT DOCUMENTS 6,526,377 B1 * 2/2003 Bubb ..... 704/211
6,898,565 B2 * 5/2005 Bubb ..... 704/211
7,120,577 B2 * 10/2006 Bubb ..... 704/211

* cited by examiner

*Primary Examiner*—Susan McFadden
(74) *Attorney, Agent, or Firm*—Grossman, Tucker, Perreault & Pfleger, PLLC

(57) ABSTRACT

A method of pitch corrected speed control (PCSC) playback in which a decoder rate controller receives a desired playback speed from a PCSC controller and determines the number of decoded digital audio samples stored in a buffer. The rate controller then determines the required number of execution times of a parametric speech decoder based on the desired playback speed and the number of decoded samples stored in the buffer. The parametric speech decoder is then executed the determined number of times.

18 Claims, 2 Drawing Sheets

SPEED CONTROL PLAYBACK OF PARAMETRIC SPEECH ENCODED DIGITAL AUDIO

FIELD OF THE INVENTION

One embodiment of the present invention is directed to digital audio. More particularly, one embodiment of the present invention is directed to speed control of digital audio playback.

BACKGROUND INFORMATION

Audio data is increasingly being stored in digital form and played back after being converted back to analog form. For example, most audio music, whether stored on a Compact Disk ("CD") or in compressed Moving Picture Experts Group, audio layer 3 ("MP3") form, is digital. Sometimes there is a need to playback audio digital data at a different speed than what was recorded. Many digital answering machines and digital dictaphone systems allow for playback of digital messages at variable speeds.

One feature of variable speed playback that is commonly found in voice mail systems is pitch corrected speed control ("PCSC"). PCSC allows a user to control the playback speed of digital audio without the audio pitch being modified.

Many voice mail systems and other systems that have PCSC compress stored audio digital data. The data must then be decoded by a decoder before it is received by a controller that implements the PCSC. Therefore, the decoder must supply the correct amount of decoded data, and the amount of decoded data required will differ depending on the playback speed requested.

The typical voice mail system that includes PCSC encodes/compresses the stored data using a waveform coder. Waveform coders attempt to preserve the form of an audio speech wave. Examples of waveform coders include Pulse Code Modulation ("PCM"), Mu-law or A-law coders. Each waveform decoder execution produces one decoded sample.

A parametric coder can provide advantages over a waveform coder because the speech can be more highly compressed by representing speech with a set of parameters. Examples of parametric coders include Linear Prediction Coefficient ("LPC") and code excited linear prediction ("CELP") coders. Unlike waveform decoders, each parametric decoder execution produces a block of decoded samples. The size of the block is different for different parametric coders, but may be a fixed size of about a multiple of groups of ten samples. This makes it difficult to implement a parametric coder/decoder in a voice mail system having PCSC because of differences between the decoder output sample number and the number of samples needed by the controller.

Based on the foregoing, there is a need for a digital audio playback system having a parametric decoder and PCSC.

DETAILED DESCRIPTION

One embodiment of the present invention is a variable speed digital audio playback system having a parametric speech decoder in which the amount of decoded data provided to a buffer prevents overflow or underrun conditions.

Figure 1:
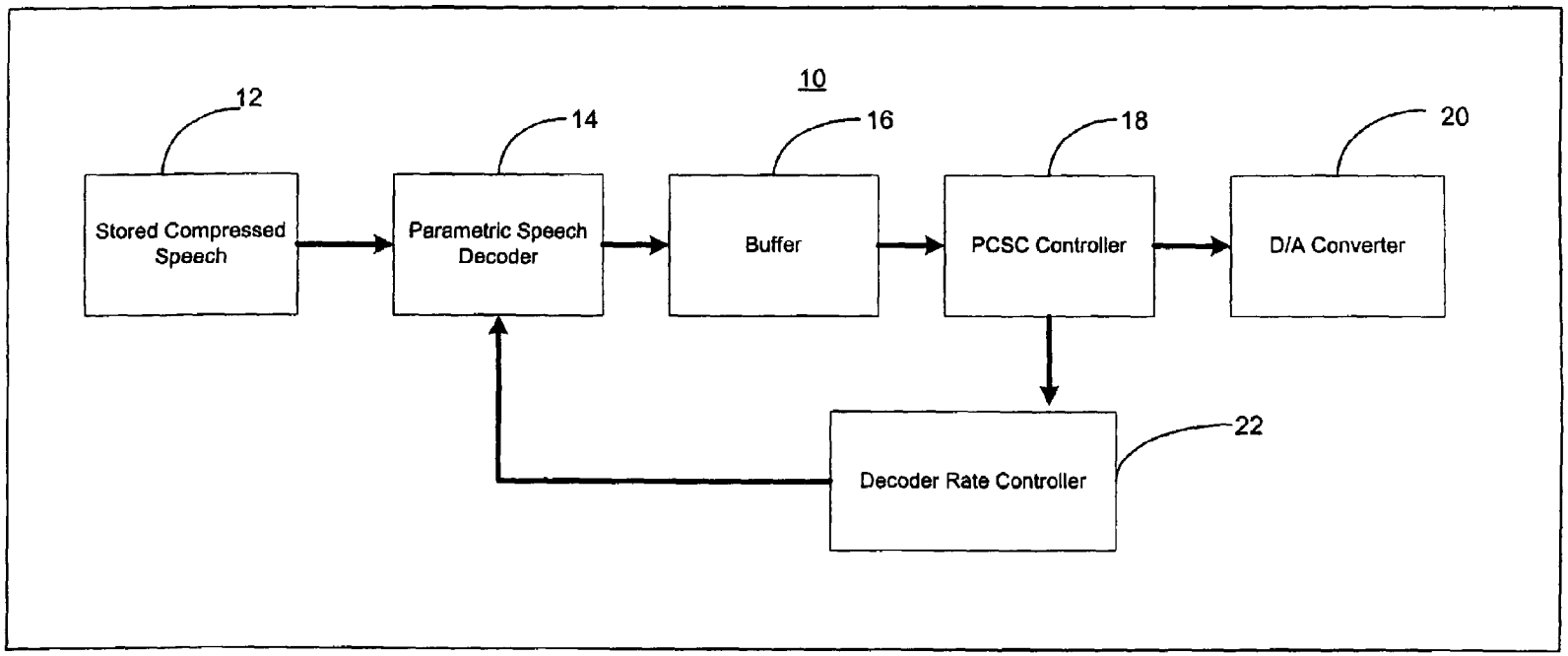
FIG. 1 is a block diagram of a digital audio playback system in accordance with one embodiment of the present invention.

FIG. 1 is a block diagram of a digital audio playback system 10 in accordance with one embodiment of the present invention. System 10 includes a storage device 12 for storing compressed speech. The speech or other audio data has been compressed by a parametric coder and other devices that are not shown in FIG. 1. Storage device 12 may be any type of memory, including a disk drive or Random Access Memory ("RAM").

Coupled to storage device 12 is a parametric speech decoder 14. Parametric speech decoder 14 decodes compressed speech, in the form of a block of data retrieved from storage device 12, and outputs speech samples. Speech decoder 14 generates "Y" samples per execution. In one embodiment, Y equals 196. Parametric speech decoder 14 may be implemented by a digital signal processor ("DSP"). In one embodiment, parametric speech decoder 14 is an LPC decoder, or a CELP decoder, or a Global System for Mobile Communications ("GSM") compatible decoder. The speech samples output by decoder 14 are stored in a buffer 16. Buffer 16 may be implemented by RAM, and may be a first in/first out ("FIFO") buffer.

System 10 further includes a PCSC controller 18 coupled to buffer 16. PCSC controller 18 controls the rate that decoded samples are played back, while maintaining a constant pitch. PCSC controller 18 retrieves data from buffer 16 at a variable rate, depending on the required playback speed, and outputs the data at a constant rate. In one embodiment, PCSC controller 18 is implemented by a DSP. In one embodiment, PCSC controller 18 is the DM3 controller by Intel Corp. The output of PCSC controller 18 is converted to analog form by a digital-to-analog converter 20. The analog output can be played back to a user.

In general, one embodiment of PCSC controller 18 maintains a constant output rate from the varying input rate by executing two functions. First, the audio pitch period of the input is determined. Second, the samples in the pitch period is duplicated or discarded. For slow play, the input rate is less than the output rate. By duplicating the samples in the period, the rate is increased to match the output rate. For the fast play, the input rate is higher than the output rate. Samples in the period are deleted to meet the output rate.

System 10 further includes a decoder rate controller 22. Rate controller 22 receives the requested playback speed from PCSC controller 18, and controls the execution of parametric speech decoder 14 so that the optimum number of speech samples are stored in buffer 16 to prevent overflows to buffer 16 or underruns when the samples are retrieved by PCSC controller 18.

In one embodiment of digital audio playback system 10, digital speech is played back through a series of tasks that are executed in a task period. A PCSC task can be scheduled every (P*task period). A decoder task can be scheduled every (N*task period). Both N and P are positive constant integers. In one embodiment, system 10 is a real time system that is equipped with relatively smaller and limited size of memory. In addition, processor millions of instructions per second ("MIPS") must be shared by all the tasks so that the real time signals can be processed.

One embodiment of the present invention controls the execution of parametric speech decoder 14 to enable PCSC controller 18. The execution of parametric speech decoder 14 is a task and shares MIPS with other tasks of system 10. The presence of samples in buffer 16 is guaranteed. The number of samples in buffer 16 is bounded and the buffer size required is the minimum. The play speed can be changed in the middle of the playback.

In one embodiment, decoder rate controller 22 calculates the number of decoder executions "K". Decoder 14 is repeated by K times during the decoder task and the samples are written to buffer 16. PCSC controller 18 reads the samples from buffer 16 every P task period.

In one embodiment, the execution loop count K is calculated by the following equation ("equation (1)"), in which K is the smallest non-negative integer that satisfies the following inequality:

$$(Y*K)+BUFLEV-(J*D)>=L*2 \quad (1)$$

Where:

Y: The number of decoded samples per execution of parametric speech decoder 14. In one embodiment, Y=196 samples.

BUFLEV: The existing number of decoded samples stored in buffer 16.

J: The amount of data read from buffer 16 by PCSC controller 18 for the play speed.

N: The number of task periods between the decoder 14 task. For example, N=2 for the decoder 14 task to be executed every other task period.

P: The number of task periods between the PCSC controller 18 task.

L: The highest PCSC controller 18 input rate corresponding to the highest play speed. In one embodiment, L=144.

D: A roundup of N/P to the nearest integer. D represents a maximum number of the PCSC controller 18 tasks between the parametric speech decoder 14 tasks. For example, if N=3 and P=2, D is equal to 2. In this example, sometimes there is one PCSC controller 18 task or two PCSC controller 18 tasks between the parametric speech decoder 14 task.

In accordance with equation (1), parametric speech decoder 14 is executed K times, where K is determined by decoder rate controller 22 using equation (1). After every parametric speech decoder 14 task, PCSC controller 18 reads the samples from buffer 16 a maximum of D times, each time reading J samples. (Y*K) is the total number of samples written to buffer 16. (J*D) is the total number of samples read from buffer 16 by PCSC controller 18. If the (Y*K) is not equal to and greater than (J*D), there will be some residual samples in buffer 16. The leftover samples in buffer 16 are contributed to the new K calculation by decoder rate controller 22. [(Y*K)+BUFLEV] is the total number of samples that can be read. In one embodiment, it must be greater than the samples read by PCSC controller 18.

The PCSC controller 18 task and parametric speech decoder 14 task have the priorities in a real time system. If the task assignments are overlapped, the higher priority task is executed while the lower priority task is delayed until the higher priority task is complete. In one embodiment, there is the worst case scenario where the PCSC controller 18 task is delayed and the parametric speech decoder 14 task is delayed due to some higher priority tasks. This causes two more PCSC controller 18 task executions. The L*2 in the equation (1) ensures an adequate number of samples in buffer 16 for the worst case scenario.

Figure 2:
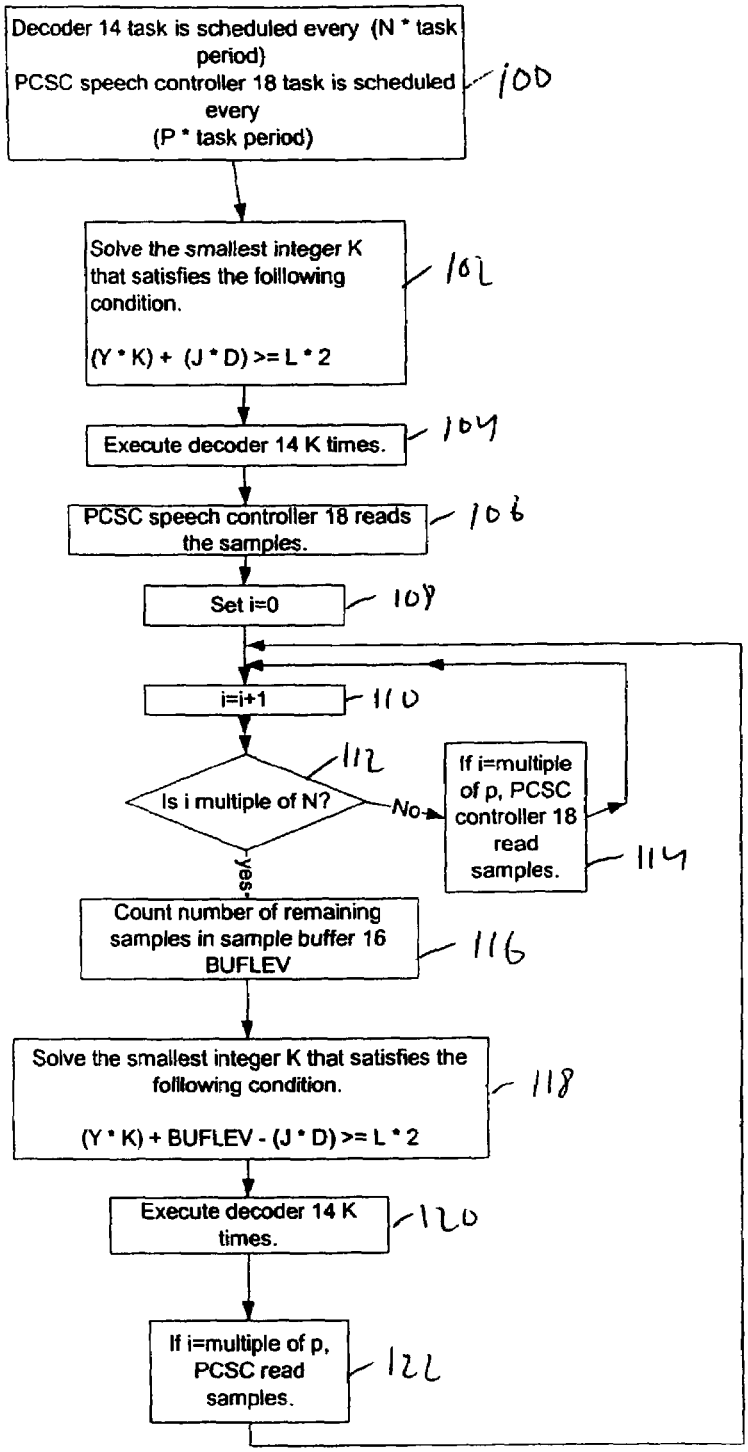
FIG. 2 is a flow diagram of some of the functionality performed by the digital audio playback system in accordance with one embodiment of the present invention.

FIG. 2 is a flow diagram of some of the functionality performed by digital audio playback system 10 in accordance with one embodiment of the present invention. In one embodiment, the functionality is implemented by software stored in memory and executed by a processor. In other embodiments, the functionality can be performed by hardware, or any combination of hardware and software.

In general, the functionality of FIG. 2 provides a method of PCSC playback in which decoder rate controller 22 receives a desired playback speed from PCSC controller 18. Rate controller 22 then determines the required number of execution times of parametric speech decoder 14 based on the desired playback speed and the number of decoded samples stored in buffer 16 using equation (1). Parametric speech decoder 14 is then executed the determined number of times.

At box 100, at initiation, each parametric speech decoder 14 task is scheduled every (N*task period) and each PCSC controller 18 task is scheduled every (P*task period).

At box 102, decoder rate controller 22 solves the smallest integer K that satisfies the following equation:

$$(Y*K)+BUFLEV-(J*D)>=L*2 \quad (2)$$

At box 104, parametric speech decoder 14 is executed K times, where K is determined at box 102.

At box 106, PCSC controller 18 reads the generated samples stored in buffer 16.

At box 108, variable "i" is set to 0.

At box 110, variable "i" is incremented by 1.

At decision point 112, it is determined whether i is a multiple of N. If not, at box 114, if i is a multiple of P, then PCSC controller 18 reads the generated samples stored in buffer 16. The flow then returns to box 110.

If it is determined that i is a multiple of N at decision point 112, then at box 116 the number of remaining samples in buffer 16 is determined as BUFLEV.

At box 118 decoder rate controller 22 solves the smallest integer K that satisfies equation (1) above.

At box 120, parametric speech decoder 14 is executed K times, where K is determined at box 118.

At box 122, if i is a multiple of P, then PCSC controller 18 reads the generated samples stored in buffer 16. The flow then returns to box 110.

As described, the variable speed digital audio playback system in accordance with one embodiment of the present invention includes a decoder rate controller that determines the amount of execution required by a parametric speech decoder based on the amount of decoded speech samples in a buffer, and the playback speed requirement of a PCSC controller. The amount of execution prevents overflow or underrun of a sample buffer.

Several embodiments of the present invention are specifically illustrated and/or described herein. However, it will be appreciated that modifications and variations of the present invention are covered by the above teachings and within the purview of the appended claims without departing from the spirit and intended scope of the invention.

What is claimed is:

1. A method of pitch corrected speed control (PCSC) playback comprising:

receiving a desired playback speed;

determining a first number of decoded digital audio samples stored in a buffer;

determining a second number of execution times of a parametric speech decoder based on the desired playback speed and the first number of decoded samples;

executing the parametric speech decoder the second number of times; and converting at least one digital audio sample to an analog audio output signal.

2. The method of claim 1, further comprising:

reading the at least one stored digital audio samples from the buffer at a PCSC controller.

3. The method of claim 2, wherein the determining the second number of execution times comprises determining K, wherein K is the smallest non-negative integer that satisfies the following:

$$(Y*K)+BUFLEV-(J*D)>=L*2.$$

4. The method of claim 3, wherein Y is a third number of decoded samples per execution of the parametric speech decoder, BUFLEV is the first number of decoded digital audio samples stored in the buffer, J is an amount of data read from the buffer by the PCSC controller, N is a fourth number of task periods between a first task of the parametric speech decoder, P is a fifth number of task periods between a second task of the PCSC controller, L is a highest play speed, and D is a roundup of N/P to a nearest integer.

5. The method of claim 2, further comprising: converting the plurality of stored digital audio samples into an analog output.

6. The method claim 2, wherein the PCSC controller reads the digital audio samples at a variable rate, and outputs the digital audio samples at a constant rate.

7. The method of claim 6, further comprising:

determining an audio pitch period; and duplicating or discarding a portion of the digital audio samples based on the audio pitch period.

8. A pitch coffected speed control (PCSC) playback system comprising:

a parametric speech decoder;

a buffer coupled to said parametric speech decoder;

a PCSC controller coupled to said buffer; and a decoder rate controller coupled to said PCSC controller, said decoder rate controller is adapted to: receive a desired playback speed; determine a first number of decoded digital audio samples stored in said buffer; determine a second number of execution times of said parametric speech decoder based on the desired playback speed and the first number of decoded samples; and execute said parametric speech decoder the second number of times;

said PCSC controller is configured to output a plurality of digital audio samples to be converted to at least one analog audio output signal.

9. The system of claim 8, wherein said PCSC controller is adapted to read said at least one stored digital audio samples from said buffer.

10. The system of claim 9, wherein the decoder rate controller determine the second number of execution times by determining K, wherein K is the smallest non-negative integer that satisfies the following:

$$(Y*K)+BUFLEV-(J*D)>=L*2.$$

11. The system of claim 10, wherein Y is a third number of decoded samples per execution of said parametric speech decoder, BUFLEV is the first number of decoded digital audio samples stored in said buffer, J is an amount of data read from said buffer by said PCSC controller, N is a fourth number of task periods between a first task of said parametric speech decoder, P is a fifth number of task periods between a second task of said PCSC controller, L is a highest play speed, and D is a roundup of N/P to a nearest integer.

12. The system of claim 9, wherein said digital-to-analog converter is coupled to said PCSC controller.

13. The system of claim 9, wherein said PCSC controller is adapted to read the digital audio samples at a variable rate, and output the digital audio samples at a constant rate.

14. The system of claim 9, wherein said PCSC controller is further adapted to:

determine an audio pitch period; and duplicate or discard a portion of the, digital audio samples based on the audio pitch period.

15. A computer readable medium having instructions stored thereon that, when executed by a processor, implements pitch coffected speed control (PCSC) playback by causing the processor to:

receive a desired playback speed;

determine a first number of decoded digital audio samples stored in a buffer;

determine a second number of execution times of a parametric speech decoder based on the desired playback speed and the first number of decoded samples;

execute the parametric speech decoder the second number of times; and convert at least one digital audio sample to an analog audio output signal.

16. The computer readable medium of claim 15, said instructions further causing said processor to:

read the at least one stored digital audio samples from the buffer.

17. The computer readable medium of claim 16, wherein the processor determines the second number of execution times by determining K, wherein K is the smallest non-negative integer that satisfies the following:

$$(Y*K)+BUFLEV-(J*D)>=L*2.$$

18. The computer readable medium of claim 17, wherein Y is a third number of decoded samples per execution of the parametric speech decoder, BUFLEV is the first number of decoded digital audio samples stored in the buffer, J is an amount of data read from the buffer by the PCSC controller, N is a fourth number of task periods between a first task of the parametric speech decoder, P is a fifth number of task periods between a second task of the PCSC controller, L is a highest play speed, and D is a roundup of N/P to a nearest integer.

* * * * *